US008662856B2

(12) United States Patent
Christensen et al.

(10) Patent No.: US 8,662,856 B2
(45) Date of Patent: Mar. 4, 2014

(54) PUMP CONTROL SYSTEM

(75) Inventors: Jerry Christensen, Wooster, OH (US); Jeff Benson, Cardington, OH (US); David Durstine, Wooster, OH (US)

(73) Assignee: Akron Brass Co., Wooster, OH (US)

( * ) Notice: Subject to any disclaimer, the term of this patent is extended or adjusted under 35 U.S.C. 154(b) by 253 days.

(21) Appl. No.: 13/029,809

(22) Filed: Feb. 17, 2011

(65) Prior Publication Data

US 2011/0200461 A1 Aug. 18, 2011

Related U.S. Application Data

(60) Provisional application No. 61/305,194, filed on Feb. 17, 2010.

(51) Int. Cl.
*F04B 49/22* (2006.01)
*F16K 31/12* (2006.01)
*E03B 5/00* (2006.01)

(52) U.S. Cl.
USPC ..... 417/28; 417/29; 137/487.5; 137/565.15

(58) Field of Classification Search
USPC ..... 417/26–29; 137/565.15, 487.5, 563
See application file for complete search history.

(56) References Cited

U.S. PATENT DOCUMENTS 2,711,929 A 6/1955 Nielsen
3,226,011 A * 12/1965 Gustafson ..... 417/28
3,286,636 A * 11/1966 Schaub ..... 417/28
4,189,005 A 2/1980 McLoughlin
4,246,969 A 1/1981 McLoughlin et al.
4,324,294 A 4/1982 McLoughlin et al.
4,345,654 A 8/1982 Carr
4,561,459 A 12/1985 Jackman
4,949,794 A 8/1990 Petit et al.
5,044,445 A 9/1991 Kayahara
5,249,631 A 10/1993 Ferren
5,249,632 A 10/1993 Sparling et al.
5,795,328 A * 8/1998 Barnitz et al. ..... 604/67
5,797,421 A 8/1998 Merrett
5,846,085 A 12/1998 Witt, III
5,860,479 A 1/1999 LaFollette
5,888,051 A 3/1999 McLoughlin et al.
6,444,088 B2 9/2002 Rokman et al.
6,547,528 B1 4/2003 Yoshida
6,651,900 B1 11/2003 Yoshida
6,685,104 B1 2/2004 Float et al.
6,816,072 B2 11/2004 Zoratti
(Continued)

FOREIGN PATENT DOCUMENTS

WO 2012033920 A1 3/2012

*Primary Examiner* — Charles Freay
(74) *Attorney, Agent, or Firm* — James R. Eley; Michael A. Forhan; Eley Law Firm Co., LPA

(57) ABSTRACT

A pump control system includes a source of pressurized fluid an output valve adjustably controls the flow of pressurized fluid from the source. An output valve control is coupled to the output valve and monitors the actual state of the output valve. The control selectably adjusts the output valve in response to a first control signal. A controller is coupled to the output valve control, the controller receiving information from the output valve control corresponding to the actual state of the output valve and providing to the output valve control the first control signal, the first control signal being applied to the output valve to achieve and maintain a desired state.

18 Claims, 1 Drawing Sheet

(56) References Cited

U.S. PATENT DOCUMENTS

| | | | |
|---|---|---|---|
| 6,993,421 | B2 | 1/2006 | Pillar et al. |
| 7,040,868 | B2 | 5/2006 | McLaughlin et al. |
| 7,055,546 | B2 | 6/2006 | McLaughlin et al. |
| 7,156,133 | B2 | 1/2007 | McLaughlin et al. |
| 7,184,866 | B2 | 2/2007 | Squires et al. |
| 7,243,864 | B2 | 7/2007 | Trapp et al. |
| 7,503,338 | B2 | 3/2009 | Harrington et al. |
| 7,739,921 | B1 | 6/2010 | Babcock |
| 7,897,916 | B2 | 3/2011 | Sudakov et al. |
| 7,980,317 | B1 | 7/2011 | Preta et al. |
| 7,987,916 | B2 | 8/2011 | Laskaris et al. |
| 8,418,773 | B2 | 4/2013 | Cerrano |
| 8,517,696 | B2 | 8/2013 | McLoughlin et al. |
| 2003/0158640 | A1 | 8/2003 | Pillar et al. |
| 2004/0024502 | A1 | 2/2004 | Squires et al. |
| 2004/0026529 | A1 | 2/2004 | Float et al. |
| 2005/0047921 | A1 | 3/2005 | McLaughlin et al. |
| 2005/0061373 | A1 | 3/2005 | McLaughlin et al. |
| 2006/0011260 | A1 | 1/2006 | McLaughlin et al. |
| 2006/0131038 | A1 | 6/2006 | Lichtig |
| 2006/0180321 | A1 | 8/2006 | Yoshida |
| 2007/0164127 | A1 | 7/2007 | Lozier et al. |
| 2007/0175513 | A1 | 8/2007 | McLaughlin et al. |
| 2008/0041599 | A1 | 2/2008 | Mulkey et al. |
| 2008/0215700 | A1 | 9/2008 | Pillar et al. |
| 2008/0292472 | A1* | 11/2008 | Laskaris ..... 417/34 |
| 2010/0052310 | A1 | 3/2010 | Stoops |
| 2010/0274397 | A1 | 10/2010 | Lozier et al. |
| 2010/0319479 | A1 | 12/2010 | Sjolin et al. |
| 2011/0017477 | A1 | 1/2011 | Combs |
| 2011/0064591 | A1 | 3/2011 | McLoughlin et al. |
| 2011/0174383 | A1 | 7/2011 | Combs |
| 2011/0187524 | A1 | 8/2011 | Cochran, III |
| 2012/0061108 | A1 | 3/2012 | Cerrano |
| 2013/0105010 | A1 | 5/2013 | McLoughlin |
| 2013/0186653 | A1 | 7/2013 | Cerrano |

* cited by examiner

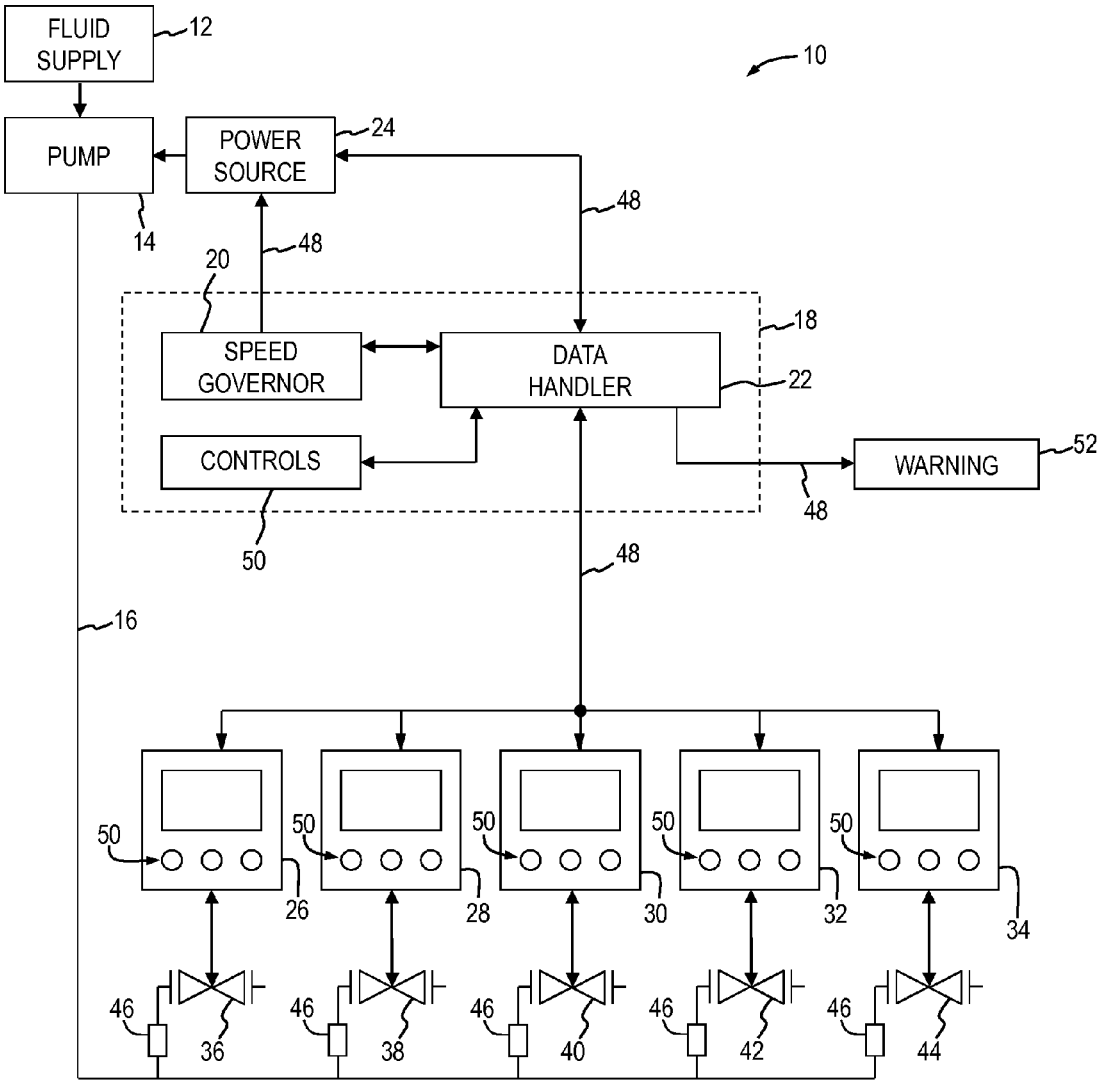
FLUID SUPPLY
12
10
PUMP
POWER SOURCE
24
14
48
20
48
18
SPEED GOVERNOR
DATA HANDLER
22
CONTROLS
WARNING
52
48
50
48
16
50
50
50
50
50
26
28
30
32
34
46
36
46
38
46
40
46
42
46
44

PUMP CONTROL SYSTEM

This application claims priority to U.S. Provisional Patent Application No. 61/305,194, filed Feb. 17, 2010, the entire contents of which are hereby incorporated by reference.

FIELD

The present invention relates generally to pump controls, in particular to a system for controlling a pump having a plurality of outputs and a plurality of selectably controlled output valves.

BACKGROUND

A modern fire engine is usually a multi-purpose vehicle carrying professionals and equipment for a wide range of fire-fighting and rescue tasks. The fire engine may have several methods of pumping water onto a fire, such as delivering water obtained from a fire hydrant through hoses and, in some cases, a pumping "monitor" (also known as a cannon or a deck gun). Some fire engines also have an onboard water reservoir from which water is pumped.

A fire engine typically includes a pump panel having a plurality of selectable valved pump outputs, the valves being controlled by electric actuators. In some arrangements a single, common pump supplies fluids to all of the valves simultaneously. The pump, in turn, is coupled through a power take-off (PTO) to a power source such as a prime mover engine of the fire engine. A governor may be provided to control the speed of the prime mover engine, in turn controlling the manifold pressure of the pump.

In some cases the temperature of the water being passed is monitored when the pump is maintaining a particular pressure with relatively low quantities of fluid flow. Some of the water is returned to a water reservoir, thereby minimizing heating of the water.

A drawback of the aforementioned pump arrangement is that operators must continuously monitor the overall system to modify valve positions, manifold pressure, and/or the power source in response to changing open or closed conditions of the output valves. A control system is needed to reduce the amount of attention and interaction required of the operator so that they are free to perform other tasks. Such a control system also preferably minimizes errors due to operator inexperience.

SUMMARY

A pump control system is disclosed according to an embodiment of the present invention. The system includes a controller having an engine speed governor and a data concentrator/processor. The controller is coupled to a power source such as a prime mover engine of a vehicle. The controller is also coupled to a plurality of valve controls including, but not limited to, a pump-to-tank recirculation valve control, a monitor valve control, and a set of handline valve controls. The controller controls the operation of the valve controls in response to operator input commands and dynamic system conditions.

An object of the present invention is a pump control system. The system includes a source of pressurized fluid. An output valve adjustably controls the flow of pressurized fluid from the source. An output valve control is coupled to the output valve and monitors the actual state of the output valve. The control selectably adjusts the output valve in response to a first control signal. A controller is coupled to the output valve control, the controller receiving information from the output valve control corresponding to the actual state of the output valve and providing to the output valve control the first control signal, the first control signal being applied to the output valve to achieve and maintain a desired state.

BRIEF DESCRIPTION OF THE DRAWING

Further features of the present invention will become apparent to those skilled in the art to which the present invention relates from reading the following specification with reference to the accompanying schematic drawing, which describes the general arrangement of a pump control system according to an embodiment of the present invention.

DETAILED DESCRIPTION

A pump control system 10 is shown in the FIGURE according to an embodiment of the present invention. System 10 includes a fluid supply 12. A fluid pump 14 is coupled to fluid supply 12 and provides a pressurized fluid source 16 for system 10. System 10 further includes a controller 18 having an engine speed governor 20 and a data concentrator/processor (hereafter "data handler") 22. Controller 18 is coupled to a power source 24 such as a prime mover engine of a vehicle. Controller 18 is also coupled to a plurality of output valve controls including, but not limited to, a pump-to-tank recirculation valve control 26, a monitor valve control 28, a first handline valve control 30, a second handline valve control 32 and a third handline valve control 34, each being coupled to and controlling the operation of a corresponding output valve 36, 38, 40, 42, 44 respectively. The aforementioned valve controls and valves are provided for example purposes only; it is understood that system 10 may be realized with a greater or lesser number of valve controls and valves within the scope of the invention.

Fluid supply 12 may be any suitable source of water including, without limitation, a municipal water supply, a reservoir carried on board a vehicle along with system 10, or a reservoir carried separate from the system, such as a reservoir carried by a separate vehicle. Fluid supply 12 may also be a natural water supply, such as lakes, rivers, ponds and streams. In other embodiments fluid supply 12 may be a supply of fire extinguishing agents including, but not limited to, dry chemical powders, foam, wet chemicals, and water with additives.

Pump 14 may be any suitable type of fluid pump providing high pressure and high volume fluid flow. Example pumps include, but are not limited to, vertical turbine pumps, vertical sump pumps, horizontal multi stage pumps, horizontal split casing pumps, and horizontal end suction pumps. Pump 14 may be a single-stage type of pump, or may be multi-stage.

Controller 18 includes speed governor 20 to control the operation of power source 24. Speed governor 20 may be implemented in any suitable form including, without limitation, electrical/electronic, electro-mechanical, mechanical, and pneumatic controls. In one embodiment, speed governor 20 controls the speed of an engine of power source 24, the pressure of the fluid source 16 delivered by pump 14 corresponding to the speed of the engine. If more pump 14 pressure is desired, speed governor 20 increases the speed of the engine. Conversely, if less pump 14 pressure is desired speed governor 20 reduces the speed of the engine.

Data handler 22 of controller 18 receives information from valve controls 26 through 34 relating to the actual state of the valve controllers and corresponding valves 36 through 44, operating in a constant flow (i.e., automatic) mode. Information supplied to data handler 22 by valve controls 26 through 34 may include, without limitation, an indication of the extent to which the valve is open or closed, internal faults in the valve control, and internal faults in the valve. Data handler 22 also transmits command signals to valve controls 26 through 34, the command signals instructing the valve controls to open or close the valves to a predetermined extent corresponding to the command signal. The command signals supplied by data handler 22 may direct ancillary functions of valve controls 26 through 34, such as retrieving or clearing data stored internally by the valve controls, and clearing faults in the valve controls and/or valves 36 through 44.

A portion of controller 18, such as data handler 22, may include a digital microprocessor-based control unit configured to receive input signals from valve controls 26 through 34 and process the signals according to a predetermined control logic to provide signals that control the operation of the valve controls and/or power source 24. Alternatively, controller 18 may comprise other digital architectures utilizing, for example, a computer, microcontroller, programmable logic device and the like. The control logic of controller 18 may be defined by a set of predetermined instructions, such as a computer program or by "fuzzy logic." In other embodiments of the present invention portions of controller 18 may be analog, such as an analog closed-loop control system. Controller 18 may be a separate, standalone component or made integral with (or distributed among) other vehicle control components, such as on-board computer controls.

Power source 24 may be the prime mover engine for a vehicle, such as a fire engine. In one embodiment of the present invention system 10 is installed to the vehicle and controls the prime mover engine of the vehicle, which functions as power source 24. Alternatively, power source 24 may be remote from the vehicle. Power source 24 may also be a gasoline or diesel engine, or an electric- or battery-powered motor.

Valve controls 26, 28, 30, 32 and 34 each receive command signals from controller 18 and respond accordingly. For example, valve controls 26, 28, 30, 32 and 34 may receive a command signal from controller 18 to open or close the corresponding valve 36, 38, 40, 42, 44 to a predetermined corresponding desired state ranging from 0% (i.e., fully closed) to 100% (i.e., fully open). In response, valve controls 26, 28, 30, 32 and 34 may activate relays, solenoids, actuators, mechanical linkages and the like on the valve controls and/or the valves to adjust the valves to the commanded state. Valve controls 26, 28, 30, 32 and 34 may be any or all of electrically, mechanically, electro-mechanically, hydraulically or pneumatically coupled to corresponding valves 36, 38, 40, 42, 44.

Valve controls 26, 28, 30, 32 and 34 may also receive commands from controller 18 relating to clearing faults in the valve controls and the corresponding valves, such as resetting fault indications, deactivating faulty portions, and activating alternate or auxiliary valve control portions and valve portions to restore operation of the valve control and/or valve.

Valve controls 26, 28, 30, 32 and 34 may also generate data relating to the performance, state, status and "health" of the valve controls and/or the valves and supply the data to controller 18. The data may be provided upon command by controller 18, periodically, or upon the occurrence of a condition precedent. Valve controls 26, 28, 30, 32 and 34 may also store the data for later retrieval by controller 18.

Valves 36, 38, 40, 42 and 44 regulate the flow or pressure of a fluid flowing therethrough. Valves 36, 38, 40, 42 and 44 may be any suitable type of flow control valve including, but not limited to, orifice-type valves, flow regulator valves, bypass flow regulator valves, demand-compensated flow regulator valves, pressure-compensated variable flow valves, pressure and temperature-compensated flow control valves, priority valves, and deceleration valves.

Valves 36, 38, 40, 42 and 44 may each include a flow measurement device 46 to provide valve controls 26, 28, 30, 32 and 34 and/or controller 18 with information relating to the fluid flowing through the valves. Flow measurement device 46 may be any suitable device for measuring fluid flow, such as mechanical, pressure-based, optical, open channel, thermal mass, vortex, electromagnetic, ultrasonic, coriolis, magnetic, ultrasonic, and laser Doppler flow measuring devices. Flow measurement device 46 may further include a sensor or sensors for measuring the temperature of the fluid flowing through the associated valve.

Any suitable electronic communications means 48 may be utilized to facilitate the transfer of electrical data and command signals between any or all of pump 14, controller 18, power source 24, valve controls 26, 28, 30, 32 and 34, and valves 36, 38, 40, 42 and 44. Electronic communication means 48 may be, without limitation, dedicated wiring, parallel data buses and serial buses. In one embodiment of the present invention controller 18 is coupled to power source 24 and valve controls 26 through 34 with a controller area network (CAN), a vehicle bus standard designed to allow controllers and devices to communicate with each other within a vehicle without a host computer.

In operation of pump control system 10, a user activates power source 24, which in turn drives pump 14 to generate pressurized fluid source 16. Pressurized fluid source 16 is provided to valves 36, 38, 40, 42 and 44. The user adjusts a set of operator controls 50 of valve controls 26, 28, 30, 32 and 34 (and, optionally, controller 18) to set the flow of fluid from the corresponding valves 36, 38, 40, 42 and 44 to a desired valve state to achieve the desired flow of fluid. Controller 18 monitors the flow of fluid through the output valves 36, 38, 40, 42 and 44 via valve controls 26, 28, 30, 32 and 34 and adjusts the valves, again via the valve controls, to maintain a desired fluid flow level by sending command signals to the valve controls, which in turn adjust the on-off state of the valves, regulating the actual flow at the desired or set flow.

Depending upon monitored system 10 conditions data handler 16 makes a decision regarding whether or not to increase power source 24/pump 14 speed/pump pressure and sends appropriate CAN messages to speed governor 20. Speed governor 20 in turn adjusts the speed of power source 24 to match the flow demand from any or all of the valve controls 26 through 34 and corresponding valves 36 through 44 respectively.

If any of valve controls 26 through 34 fall outside of a predetermined modulation envelope (i.e., greater than about 80% or less than about 20% open) during automatic mode, data handler 16 modifies the setpoint of governor 20 (and thus power source 24) up or down as necessary and/or controls the operation of pump-to-tank recirculation valve 36.

If the temperature of water being controlled by valve controls 26 through 34 exceeds a predetermined threshold, data handler 16 may command pump-to-tank recirculation valve 36 to open further.

The control of the setpoints of each of valve controls 26 through 34 may be gradually "ramped" between condition or state changes, to reduce overall loop instability of system 10.

When one or more of handline nozzles (not shown) are coupled to valve controls 30, 32 and 34 and one or more of corresponding valves 40, 42 and 44 respectively are closed (or a hose coupled to a corresponding valve output becomes kinked or otherwise obstructed) controller 18 attempts to maintain the current flow setpoint until a prolonged abnormal no-flow or low-flow condition is recognized. At that point an alarm is sensed by data handler 22 (or signaled to the data handler by the affected valve control) and the valve control for the closed/obstructed valve is set to a predetermined open position, such as about a 20% open position, awaiting normal operation condition for the valve. When normal flow is re-established (i.e., re-opening of the nozzle) controller 18 will gradually ramp up to its previous setpoint. The alarm may be acknowledged and silenced by the operator, if desired. In addition, data handler 22 may include a predetermined output signal that indicates the state of the alarm for driving remote warning lights 52, aural alerts, or other type of annunciator.

At any point in time, the flow setpoint of one or more of valve controls 26 through 34 (or controller 18) may be modified by operator controls without necessarily exiting automatic mode. Alternatively, the operator may exit automatic mode entirely or one valve at a time, with the valve controls and governor 20 maintaining their current positions.

In some embodiments of the present invention governor 20 and data handler 22 may be combined together in a single device. Alternatively, governor 20 and data handler 22 may be separate components of system 10.

While this invention has been shown and described with respect to a detailed embodiment thereof, it will be understood by those skilled in the art that changes in form and detail thereof may be made without departing from the scope of the claims of the invention.

What is claimed is:

1. A pump control system, comprising:

a fluid supply;

a pump in communication with the fluid supply, the pump being configured to generate a pressurized fluid from the fluid supply;

a pump manifold adapted to receive the pressurized fluid;

a plurality of output valves coupled to the pump manifold, the valves being configured to adjustably control the flow or pressure of the pressurized fluid, the pressurized fluid flowing from the pump manifold through the output valves, at least one of the output valves flowing fluid through to a handline or a monitor;

an output valve control coupled to each of the output valves, the output valve controls monitoring the actual state of the output valves and selectably adjusting the output valves in response to a first control signal; and a controller coupled to the output valve controls, the controller receiving information from each of the output valve controls corresponding to the actual state of the output valves and providing to the output valve controls the first control signal, the first control signal being applied to the output valves to achieve and maintain a desired state.

2. The pump control system of claim 1, further comprising a power source coupled to the pump, the pump being driven by the power source.

3. The pump control system of claim 2 wherein the controller is further coupled to the power source, and wherein the controller controls the operation of the power source in a predetermined manner corresponding to the actual state and the desired state of the output valves.

4. The pump control system of claim 3 wherein:

the power source is a prime mover; and the controller further includes an engine speed governor to control the speed of the prime mover.

5. The pump control system of claim 4 wherein the controller monitors the flow of fluid through the output valves and adjusts the speed of the prime mover to maintain a determinable flow level.

6. The pump control system of claim 1 wherein the controller further includes a data handler to process and communicate information between the controller and the output valve controls.

7. The pump control system of claim 6, further including electronic communication means extending between the data handler and the output valve controls.

8. The pump control system of claim 4 wherein the wherein the controller further includes a data handler to communicate information between the controller and the output valve controls, and between the controller and the prime mover.

9. The pump control system of claim 8, further including electronic communication means extending between the data handler, the prime mover and the output valve controls.

10. The pump control system of claim 1, further including:

a recirculation valve to adjustably divert pressurized fluid from the recirculation valve to the fluid source; and a recirculation valve control coupled to the recirculation valve, the recirculation valve control monitoring the status of the recirculation valve and selectably adjusting the recirculation valve in response to a second control signal, the controller being coupled to the recirculation valve control, the controller receiving information from the recirculation valve control corresponding to the temperature of the fluid and providing to the recirculation valve control the second control signal, the second control signal being applied to the recirculation valve to achieve and maintain a desired state corresponding to the temperature of the fluid.

11. The pump control system of claim 1, wherein the adjustment of the output valves is gradual.

12. The pump control system of claim 1, wherein the controller monitors the flow of fluid through the output valves and adjusts the valves to maintain a determinable flow level.

13. The pump control system of claim 1, wherein the controller monitors the flow of fluid through the output valves and sounds an alarm if an abnormal condition is detected.

14. The pump control system of claim 13, wherein the controller provides a control signal to the output valve controls if an abnormal condition is detected, the output valve controls adjusting the output controls to a predetermined setting corresponding to the abnormal condition.

15. The pump control system of claim 14, wherein the controller provides a control signal to the output valve controls if the abnormal condition is removed, the output valve controls adjusting the output valves to a predetermined setting corresponding to a normal operating condition.

16. The pump control system of claim 1 wherein at least one of the output valve controls and the controller further include an operator-set control configured to establish a setpoint for the amount of fluid flowing through the output valves.

17. The pump control system of claim 1 wherein the output valve controls are configured to determine, store, and transmit data corresponding to the extent open position of the output valves.

18. The pump control system of claim 1, further including:

a controller area network; and a power source;

the controller area network being configured for electronic communication between the controller, the power source and the output valve controls, the electronic communication being non-computer based.

* * * * *